US006585232B2

(12) United States Patent
Rechenmacher et al.

(10) Patent No.: US 6,585,232 B2
(45) Date of Patent: Jul. 1, 2003

(54) DEVICE FOR SETTING AND AUTOMATIC ADJUSTMENT OF THE TRACTIVE FORCE OF A CABLE OF AN OVERHEAD WINCH FOR A SKI SLOPE PREPARATION AND MAINTENANCE MACHINE

(75) Inventors: Michael Rechenmacher, Vipiteno (IT); Joseph Rainer, Termeno (IT)

(73) Assignee: Leitner S.p.A. (IT)

( * ) Notice: Subject to any disclaimer, the term of this patent is extended or adjusted under 35 U.S.C. 154(b) by 146 days.

(21) Appl. No.: 09/766,459

(22) Filed: Jan. 17, 2001

(65) Prior Publication Data

US 2001/0017366 A1 Aug. 30, 2001

(30) Foreign Application Priority Data

Jan. 21, 2000 (IT) ..... BZ2000A0005

(51) Int. Cl.[7] ..... B66D 1/08
(52) U.S. Cl. ..... 254/361
(58) Field of Search ..... 254/314, 315, 254/723, 361

(56) References Cited

U.S. PATENT DOCUMENTS 3,032,321 A * 5/1962 Plumettaz ..... 254/269
3,940,110 A * 2/1976 Motoda ..... 254/270
4,187,681 A * 2/1980 Johnson ..... 254/277
4,200,052 A * 4/1980 Cunningham et al. . 114/230.21
4,448,398 A * 5/1984 Wyatt ..... 254/361
6,371,447 B1 * 4/2002 Imanishi et al. ..... 254/361
6,382,595 B1 * 5/2002 Nold, III ..... 254/361

* cited by examiner

*Primary Examiner*—Emmanuel Marcelo
(74) *Attorney, Agent, or Firm*—Shlesinger, Fitzsimmons & Shlesinger

(57) ABSTRACT

Device for setting and automatic adjustment of the tractive forces of the cable of an overhead winch for a ski slope preparation and maintenance machine, comprises an adjustment control unit connected to a controllable winch drive; and a processing device connected to sensors and to the adjustment control unit. The sensors are pressure sensors which detect pressure applied to a selection valve with maximum value, the selection valve being connected between delivery ducts of hydraulic drives on the right-and left-hand sides of the ski slope preparation and maintenance machine in a first travel direction or a travel direction opposite thereto. The processing device includes an algorithm which calculates a nominal value based on the pressure taken by the pressure sensors and which controls the winch operation through the adjustment control unit.

4 Claims, 5 Drawing Sheets

DEVICE FOR SETTING AND AUTOMATIC ADJUSTMENT OF THE TRACTIVE FORCE OF A CABLE OF AN OVERHEAD WINCH FOR A SKI SLOPE PREPARATION AND MAINTENANCE MACHINE

FIELD OF THE INVENTION

The present invention relates to a device for setting and automatic adjustment of the tractive force of the cable of an overhead winch for a ski slope preparation and maintenance machine.

BACKGROUND OF THE INVENTION

To maintain a predetermined pulling force of a cable there are known winch adjustment devices for influencing a controllable winch operation in such a manner that exceeding or falling short of the adjusted tractive forces is avoided. Increased stress on the cable can lead to cable breakage with serious consequences. In addition the adjustment devices of known type do not allow for the dynamics of a vehicle on which they are installed and in particular the different angular positions which the cable can assume with respect to the vehicle. Due to the fact that the cable force adjustment devices in known winches are only adjustable for the nominal admissible cable tension, allowance is not made for vehicle travel circumstances and the cable is subject to tractive forces of needless magnitude for performance of certain ooperations. This needlessly reduces cable life.

The general purpose of the present invention is to remedy the above mentioned shortcomings by making available a device for setting and automatic adjustment of the tractive force allowing for the circumstances of a ski slope preparation and maintenance machine with the purpose of making the necessary tractive force available at all times but at the same time limiting it to the amount strictly necessary. In addition a nominal tractive force should be set automatically.

This purpose is achieved in accordance with the present invention by a device for setting and automatic adjustment of the tractive force of an overhead winch for a ski slope preparation and maintenance machine.

With the aid of an adjustment control unit and an algorithm deposited on it and from different measurements taken by sensors a nominal tractive force is determined. The nominal value is made up of the hydrostatic cable operation pressure of travel and the cable angle in relation to the vehicle as well as a correction factor predetermined by the operator. In a closed adjustment circuit located downstream the nominal value thus taken is compared with the real value measured by a dynamometric pin and the tractive force is adjusted to the nominal value.

As a measurement of the necessary tractive force there is the travel operation pressure. If for example the winch cable is located forward in the direction of travel and a high pressure is located on the 'leading side' of the travel operation, then the winch tractive force should also be chosen correspondingly high. But if the pressure is applied on the 'trailing side' to the winch cable directed in the direction of travel it means that the overhead winch is working against the travel traction. In this case the winch tractive force should be set very low.

In addition the winch tractive force should be reduced if it is engaged transversely to the direction of travel. If because of unfavorable snow conditions (for example fresh snow) the adjustment control unit supplied erroneous nominal values for tractive force the operator has the option of oversteering and specifically of making possible a tractive force increase or reduction.

Additional characteristics and advantages of the device in accordance with the present invention are set forth in the claims and the description given below of a preferred embodiment with reference to the annexed drawings.

DETAILED DESCRIPTION OF THE INVENTION

Figure 1:
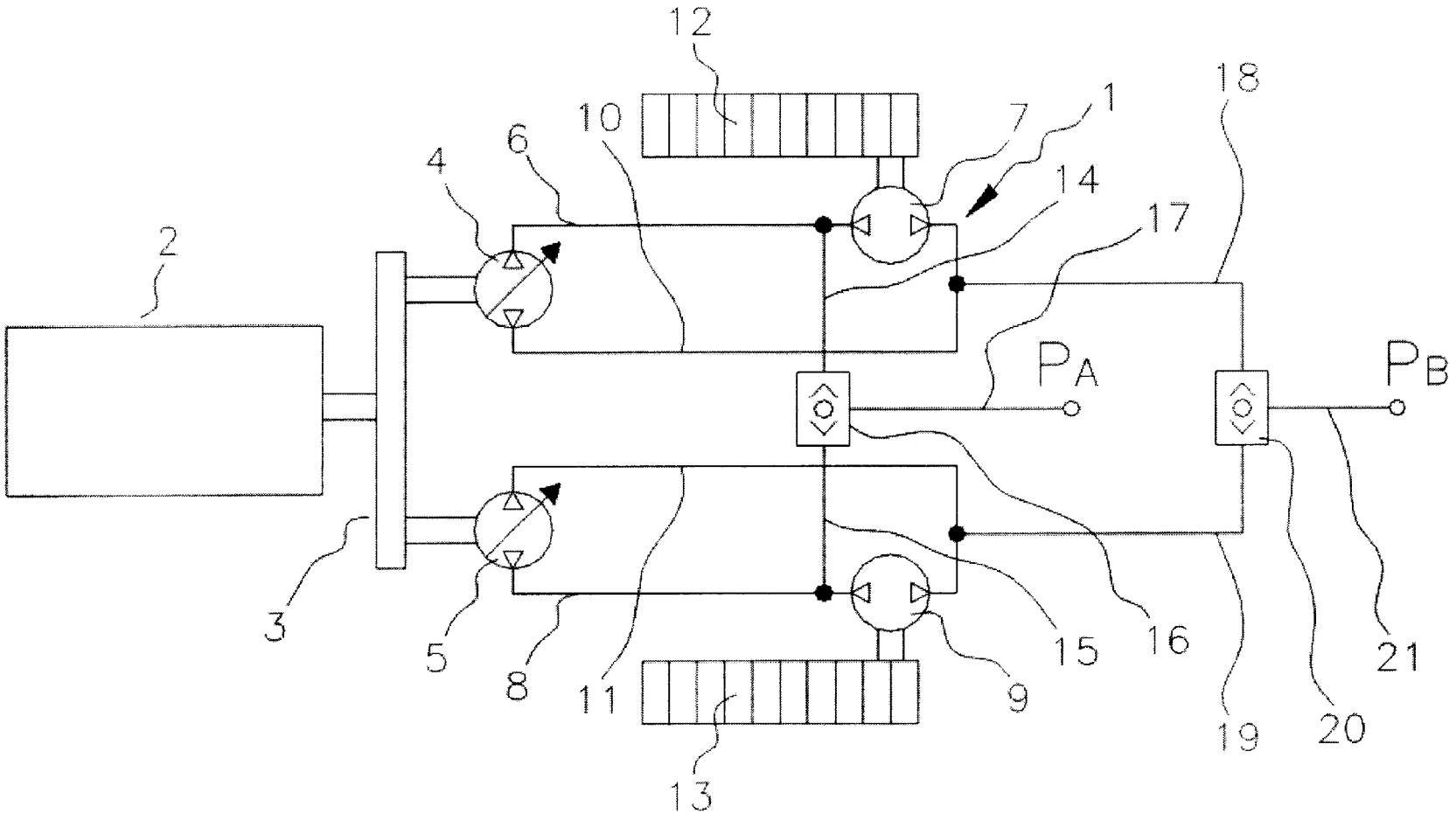
FIG. 1 shows a diagram of the device in accordance with the present invention applied to a ski slope preparation and maintenance machine of known type.

With reference to the FIGS a ski slope preparation and maintenance machine of known type is designated as a whole by reference number 1. It comprises for example a diesel engine 2 which through transmission 3 drives a first pump 4 and second pump 5. The hydraulic pump 4 feeds through a delivery duct 6 a hydraulic motor 7 and the pump 5 feeds through a delivery duct 8 a hydraulic motor 9 with fluid under pressure. The hydraulic motor 7 is connected through a return duct 10 and the hydraulic motor 9 through a return duct 11 with the pumps 4 and 5 respectively. The hydraulic motor 7 drives a track 12, right hand seen in the direction of travel, and the hydraulic motor 9 a left hand track 13. The parts described thus far of a ski slope preparation and maintenance machine are of known type and are useful only in improving understanding of the following description of the device in accordance with the present invention. The terms delivery duct and return duct refer to "forward travel" and assume the reverse meaning in the case of "rearward travel".

The delivery duct 6 is connected through a branch 14 and the delivery duct 8 through a branch 15 with a selection valve 16 capable of allowing detection of the higher of the two pressures in the ducts 6 and 8 through a duct 17 from a pressure sensor A.

In similar manner the return duct 10 is connected through a branch 18 and the return duct 8 through a branch 19 with a selection valve 20 connected through a duct 21 with a pressure sensor B.

Thus, both the pressure sensors A and B are used to measure the pressure in travel operation. The sensor A is connected through the selection valve 16 with the 'leading sides' and the sensor B is connected through the selection valve 20 with the 'trailing sides' of both the hydrostatic travel drives in the form of hydraulic motors 7 and 9. In this manner the higher pressure of the 'forward side' or 'rearward side' of the left or right travel drive respectively is applied on both sensors A and B.

Figure 2:
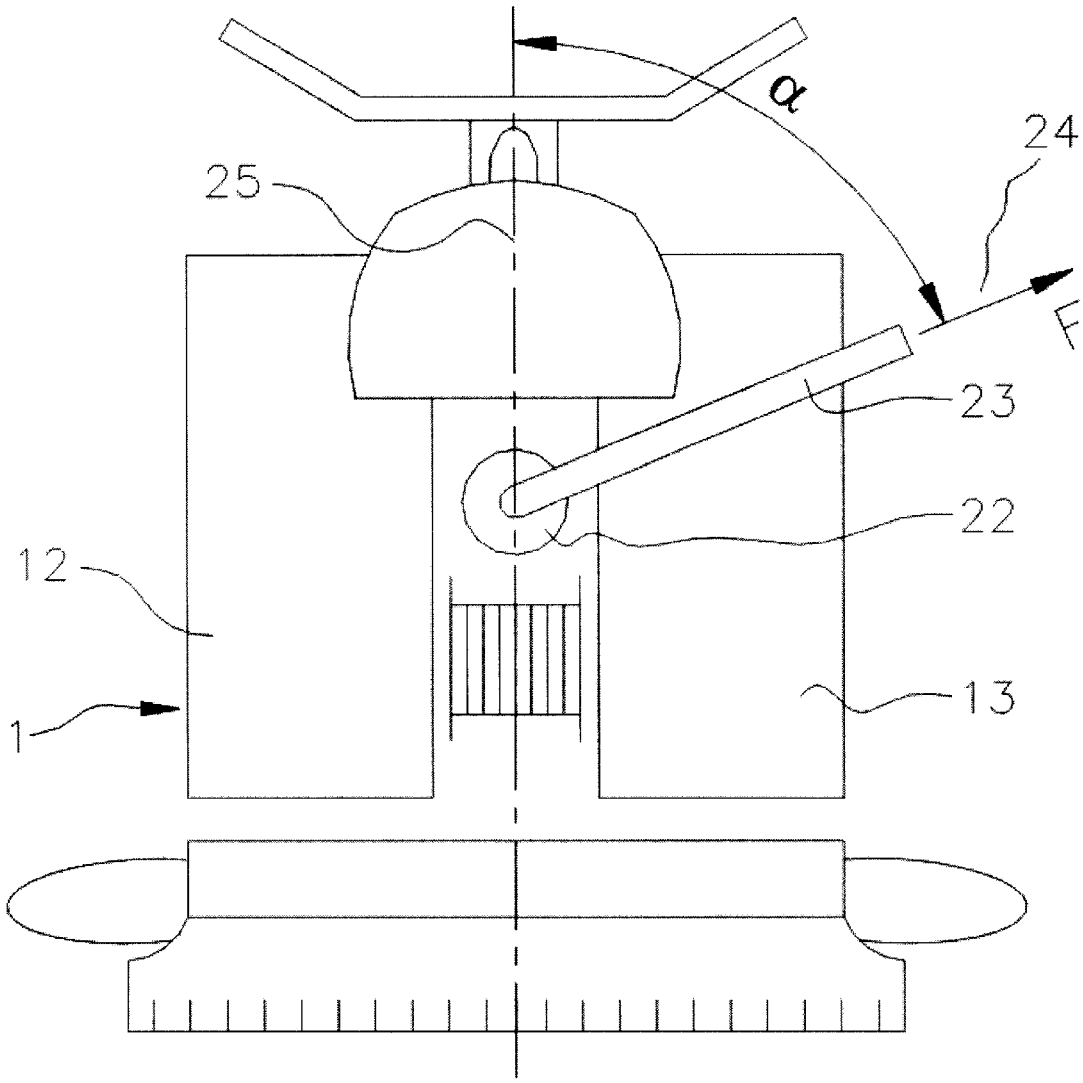
FIG. 2 shows diagrammatically a ski slope preparation and maintenance machine with overhead winch.

FIG 2 shows the ski slope preparation and maintenance machine of FIG 1 diagrammatically from above. An overhead winch is symbolized at reference number 22. It has an arm 23 guiding the winch cable 24 within an angle $\alpha$ with respect to the travel direction 25 of ski slope preparation and maintenance machine 1.

The angle α of the cable 24 or the winch arm 23 relative to the steering axis of the vehicle or the travel direction 25 is determined with the aid of a rotation angle transmitter of known type and not shown which supplies a tension signal proportionate to angle α. If the winch arm 23 is forward in the travel direction it corresponds to α=0°. If it is rearward travel direction it corresponds to an angle α=180°. The angle signal is equal for positive and negative angles (for example an angle of α=60° gives the same signal as an angle α=−60° or α=300° respectively) since a distinction between the right and left side is unimportant for tractive force determination.

Through a potentiometer not shown an adjustment value can be set by the operator. The winch tractive force adjustment control unit which works fully automatically in normal operation can be controlled by the operator with adjustment of a correction factor. The potentiometer used for this purpose can be deflected from a central position elastically loaded in a positive and negative direction. In this manner it is possible to reduce or increase the nominal tractive force determined automatically by the adjustment control unit depending on requirements. After release of the potentiometer it returns automatically with the central position so that the correction factor is zero and the tractive force nominal value is again taken fully automatically.

Determination of the nominal tractive force in the adjustment control unit takes place in two steps as follows.

Figure 3:
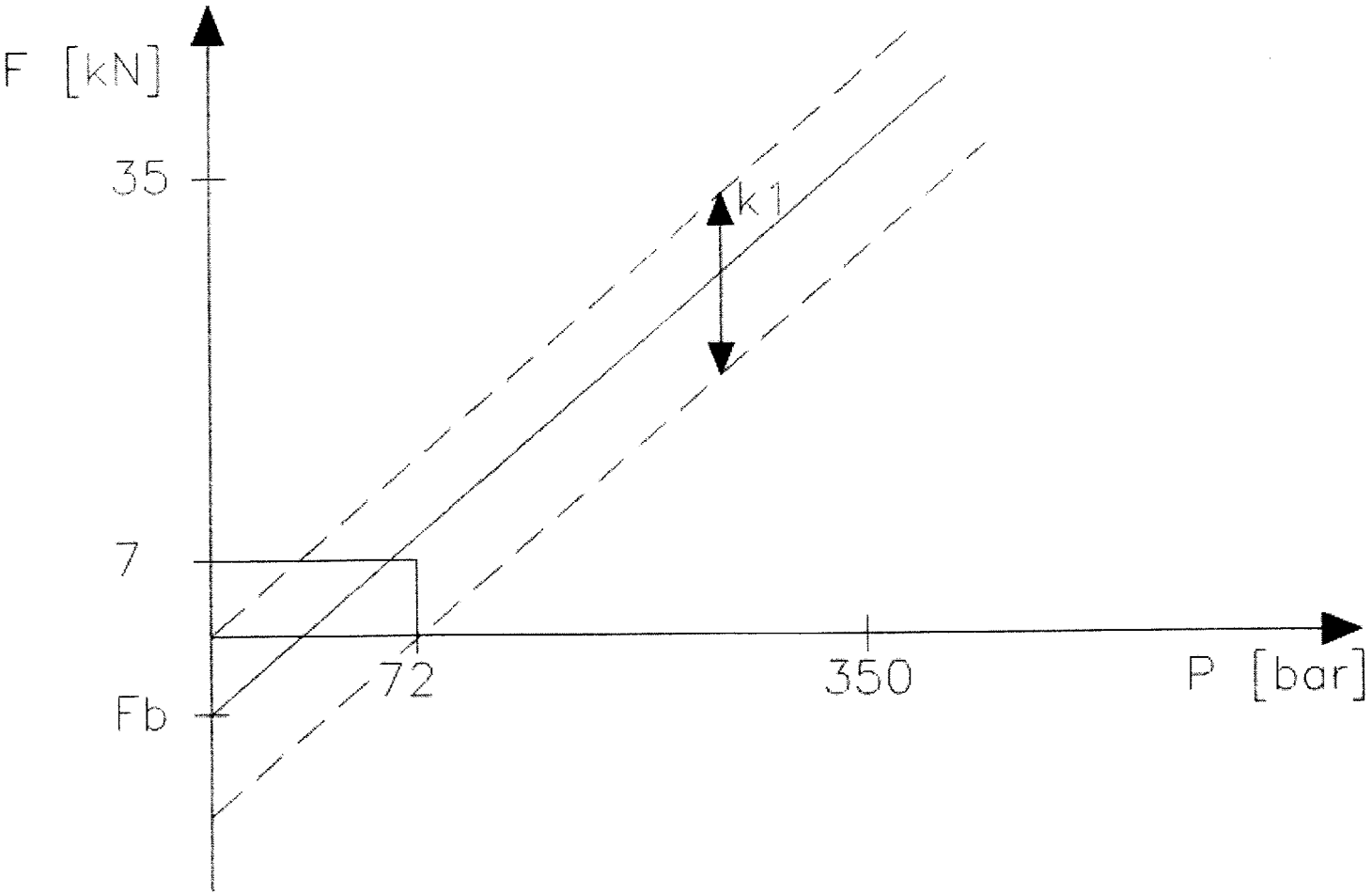
FIG. 3 shows a diagram for finding a tractive force.

As shown in FIG 3, subject to the pressure p in the travel drive and the correction factor $K_1$ which can be adjusted by the operator through the potentiometer, the tractive force factor F* is determined with reference to FIG 3 as follows.

$$F^*(p.K)=mpF_0K_1$$

Where

P—travel operation pressure (the greater of the pressure $P_A$ and $P_B$)

$F_0$=0.38 kN $K_1$—correction factor [−12kN<$K_1$<12kN], adjustable by the operator through the potentiometer.

Figure 4:
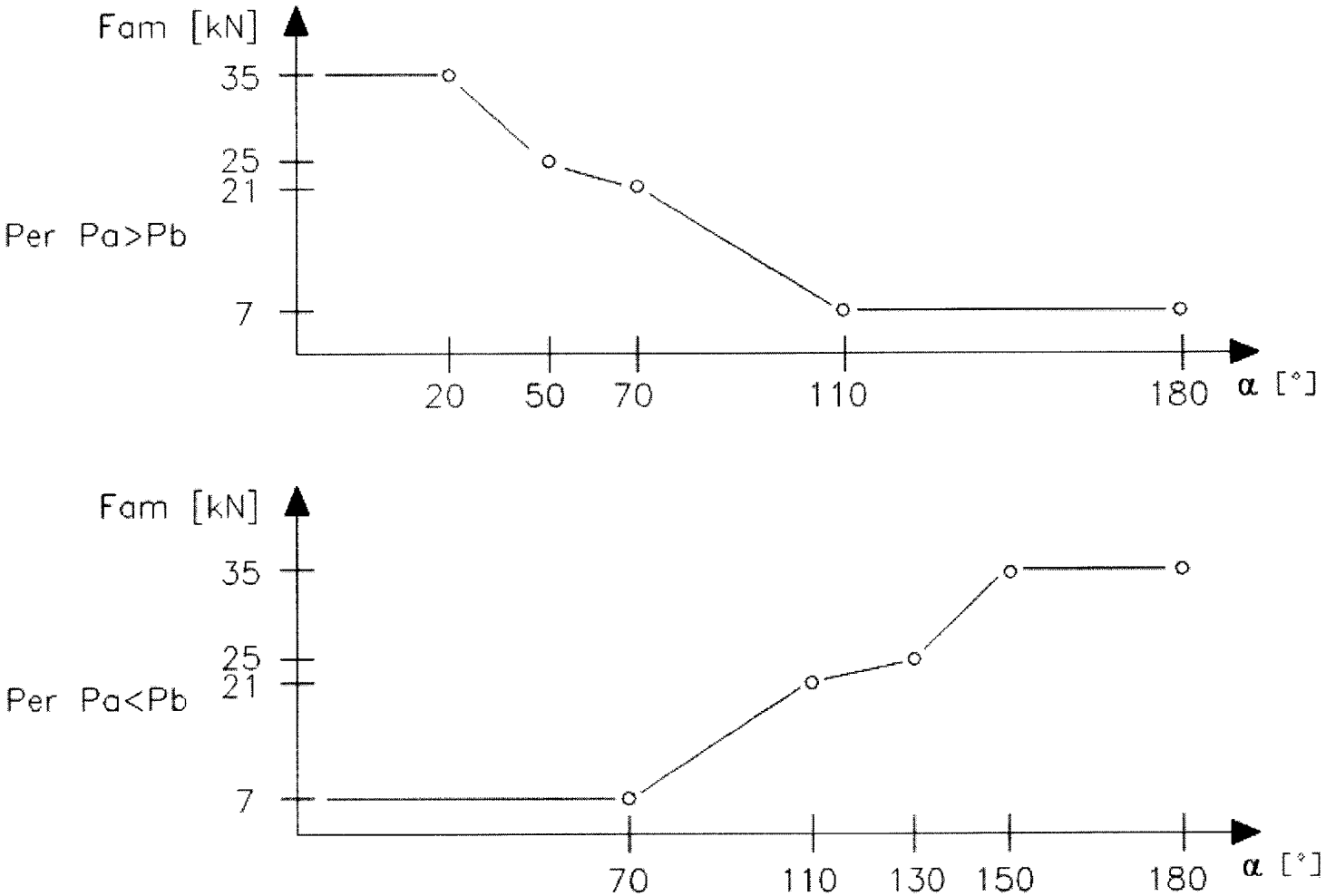
FIG. 4 shows a diagram for finding the highest allowable tractive force, and FIG. 5 show diagrammatically an adjustment circuit for comparison of a real tractive force and adjustment of the real to the nominal tractive force.
Figure 5:
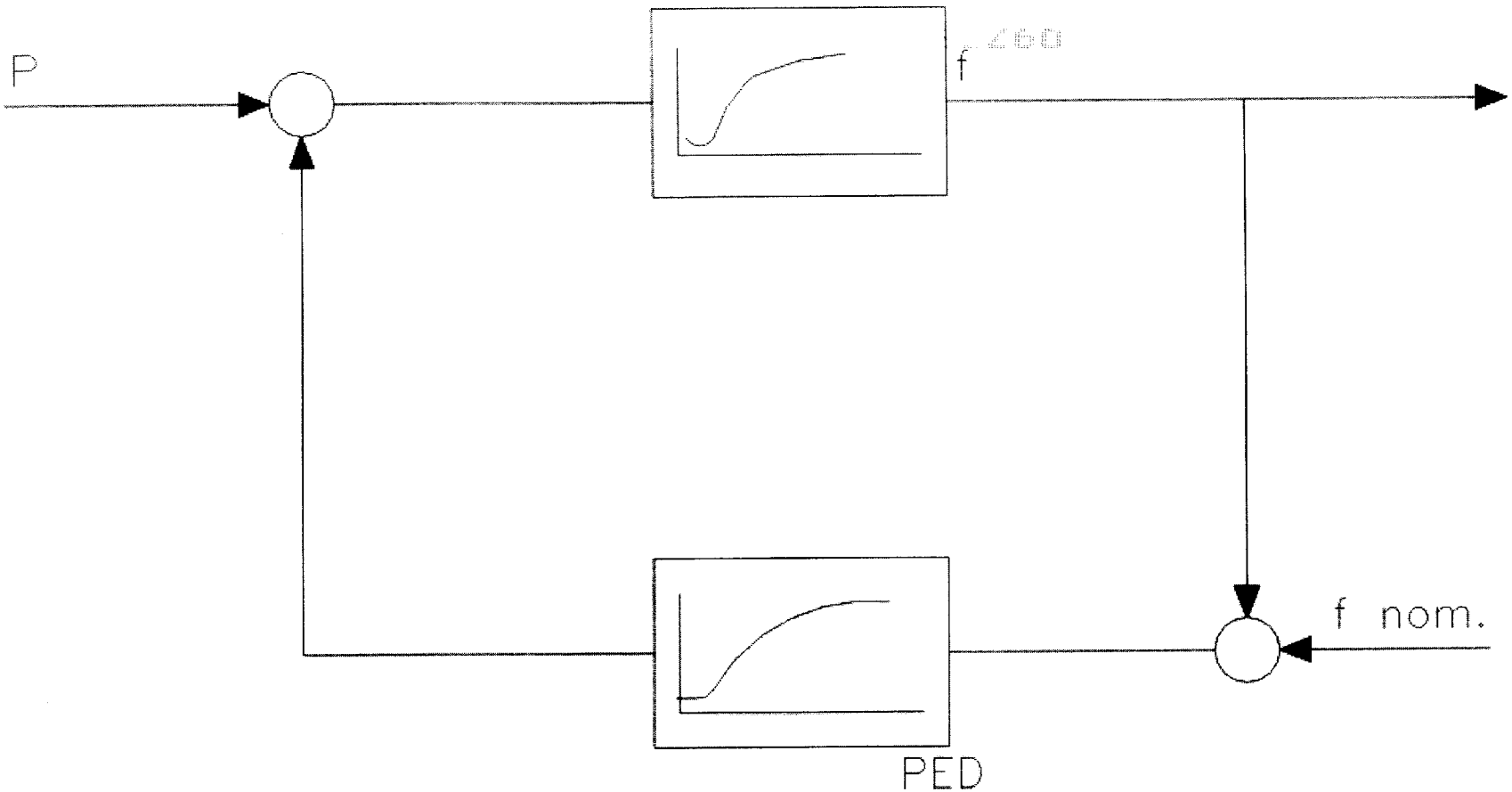

In the second step in accordance with FIG 4 depending on the angle α of the winch arm and application of the pressures $P_A$ and $P_B$ the highest admissible force Fam is determined from the upper diagram of FIG 4 which is to be applied for "loading side" pressure and the lower diagram for "trailing side" pressure.

The lesser of the values F* and Fam is the nominal tractive force value Fnom.

In a closed adjustment circuit this value is compared with the tractive force Freal and the real value is adjusted to the nominal value.

What is claimed is:

1. Device for setting and automatic adjustment of the tractive forces of the cable of an overhead winch for a ski slope preparation and maintenance machine, comprising:

a) an adjustment control unit connected to a controllable winch drive;

b) a processing device connected to sensors and to the adjustment control unit;

c) the sensors are pressure sensors which detect pressure applied to a selection valve with maximum value, the selection valve being connected between delivery ducts of hydraulic drives on the right-and left-hand sides of the ski slope preparation and maintenance machine in a first travel direction or a travel direction opposite thereto; and d) the processing device including an algorithm which calculates a nominal value based on the pressure taken by the pressure sensors and which controls the winch operation through the adjustment control unit.

2. Device as in claim 1, wherein the nominal value taken by the adjustment control unit is compared with a real value measured by a dynamometer pin applied to the tractive force to the nominal value.

3. Device as in claim 1, wherein and further comprising a rotation angle transmitter which determines the angle α of the winch cable or a cable guide arm relative to the longitudinal axis of the machine, the angle transmitter forming a signal proportional to the angle α which is fed to the processing unit for calculation of a maximum admissible tractive force.

4. Device as in claim 1, wherein one of the sensors is made up of the dynamometer pin applied to the cable for formation of a maximum nominal value tractive force.

* * * * *